United States Patent [19]

Meyer-Grünow

[11] Patent Number: 4,729,874

[45] Date of Patent: Mar. 8, 1988

[54] METHOD OF USING RAPIDLY DISSOLVING ADDITIVES FOR METAL MELTS

[75] Inventor: Hartmut Meyer-Grünow, Garching, Fed. Rep. of Germany

[73] Assignee: SKW Trostberg Aktiengesellschaft, Trostberg, Fed. Rep. of Germany

[21] Appl. No.: 892,195

[22] Filed: Jul. 31, 1986

[30] Foreign Application Priority Data

Aug. 24, 1985 [DE] Fed. Rep. of Germany ..... 3530275

[51] Int. Cl.[4] ..... C22C 1/00

[52] U.S. Cl. ..... 420/129; 75/256; 420/590

[58] Field of Search ..... 75/256, 129, 93 AC, 75/93 AB, 93 G, 246, 249; 420/590, 129

[56] References Cited

U.S. PATENT DOCUMENTS

| | | | |
|---|---|---|---|
| 2,085,802 | 7/1937 | Hardy | 75/93 G |
| 2,911,297 | 11/1959 | Florenz | 75/135 |
| 3,298,801 | 1/1967 | Goodrich et al. | 75/256 |
| 3,592,637 | 7/1971 | Brown et al. | 420/528 |
| 3,941,588 | 3/1970 | Dremann | 75/93 AC |
| 4,199,351 | 4/1980 | Gammal | 420/23 |
| 4,564,393 | 1/1986 | Murray et al. | 75/93 AC |

FOREIGN PATENT DOCUMENTS

| | | | |
|---|---|---|---|
| 1909579 | 9/1969 | Fed. Rep. of Germany . | |
| 2012655 | 11/1970 | Fed. Rep. of Germany . | |
| 1758468 | 8/1973 | Fed. Rep. of Germany | 420/23 |
| 2145943 | 2/1973 | France . | |
| 2112020 | 7/1983 | United Kingdom . | |

*Primary Examiner*—Christopher W. Brody
*Attorney, Agent, or Firm*—Felfe & Lynch

[57] ABSTRACT

The present invention provides a rapidly dissolving additive for metal melts, wherein it contains or consists of 2 to 50% by weight of a powdered component A, consisting of magnesium and/or a magnesium-containing alloy, and 50 to 98% by weight of a powdered component B, consisting of one or more alloying metals, the components A and B being intimately mixed and being present in pressed or compacted form.

18 Claims, No Drawings

METHOD OF USING RAPIDLY DISSOLVING ADDITIVES FOR METAL MELTS

The present invention is concerned with a rapidly disolving additive for metal melts for the introduction of alloying elements into metals.

In the production of metal alloys, in practice, the alloying elements are mostly added to the liquid metal bath in solid form. Thus, for example, aluminium is alloyed with magnesium in order to achieve better strengths, with silicon in order to improve the castability and strength and with manganese and chromium in order to increase the strength and the corrosion resistance. Furthermore, a whole series of other alloying elements are known for the aimed influencing of the alloy properties.

For the introduction of the alloying elements, hitherto above all the alloying metals melting at a higher temperature than the base metal were added in the form of master-alloys in order to achieve a rapid dissolving. The disadvantage of these master-alloys is their limited content of alloying metal. Thus, for example, the standard master-alloy for aluminium alloying contains, besides aluminium, only at most 20% silicon, up to 20% chromium or up to 50% manganese. Thus, the alloying elements must be added in up to the fourfold amount of aluminium, which results in increased costs for transport, storage, energy consumption and the like.

In order at least partly to avoid these disadvantages, it is known from U.S. Pat. No. 3,592,637 to use mixtures of aluminium or silicon powder with powders of alloying metals or of alloying metal alloys in briquet form. Thus, for example, there are commercially available alloy briquets containing 25% aluminium and 75% of the metals chromium, manganese and iron. The disadvantage of these alloying agents is that the proportion of alloying element is limited to 75%. as well as the limited speed of dissolving.

British Patent Specification No. 2,112,020 also describes similar mixtures in which a part of the aluminium is replaced by chloride or fluoride salts. The commercially available chromium-, manganese- and iron-containing tablets suffer from the disadvantage that, in the case of the use thereof, chloride and fluoride compounds are liberated and a noticeable amount of slag is formed, which results in undesired losses of base metal.

Therefore, it is an object of the present invention to provide an additive for metal melts which does not display the disadvantages of the prior art and, in spite of a higher concentration of alloying metal, dissolves rapidly and completely in the liquid base metal and does not cause any losses.

Thus, according to the present invention, there is provided a rapidly dissolving additive for metal melts, wherein it contains or consists of 2 to 50% by weight of a powdered component A, consisting of magnesium and/or a magnesium-containing alloy, and 50 to 98% by weight of a powdered component B, consisting of one or more alloying metals, the components A and B being intimately mixed and being present in pressed or compacted form.

We have, surprisingly, found that the additive according to the present invention, even in the case of very high contents of alloying metal, possess an unexpectedly high speed of dissolving which is higher than that of comparable aluminiun-containing alloying agents. Furthermore, no disturbing foreign substances are liberated which could possibly give rise to losses of base metal.

Component A can consist of pure magnesium and/or of a magnesiun-containing alloy insofar as, in the case of the use of the additives according to the present invention, technically unacceptable amounts of impurities are thereby not introduced into the base metal. By magnesium-containing alloys, in the scope of the present invention there are to be understood those alloys which contain at least 50% of magnesium. As alloying components, the magnesium can preferably also contain aluminium or manganese but also zinc or silicon.

The proportion by weight of component A should be as low as possible with simultaneously good dissolving properties of the alloying agent. Depending upon the density of the alloying metal, 2% by weight of component A is already sufficient. In the range of from 5 to 10% by weight of the magnesium component A, there is achieved an optimum combination of dissolving speed and concentration of the alloying elements in the additive. In the case of a content of component A of from 10 to 50% by weight, the concentration of the alloying elements in the additive is reduced without the speed of dissolving being simultaneously substantially improved.

Component B, which is present in an amount of from 50 to 98% by weight and preferably of from 90 to 95% by weight, consists of one or more alloying metals. For this purpose, in principle there can be used all alloying elements, whereby, because of their technical importance, chromium, manganese and/or iron are preferred. However, component B can also contain one or more further alloying elements, for example, nickel, cobalt, copper, silver, titanium, zirconium, hafnium, vanadium, niobium, tantalum, molybdenum and tungsten. The alloying metal does not have to be present in pure form: alloys or mixtures of several metals can also be present insofar as no undesired impurities thereby result in the base metal.

It is important for the present invention that not only component A but also component B are present in compacted or pressed form and have been obtained by pressing or compacting the intimately mixed powder components. The additive can be present in the form of briquets, tablets, pellets or the like, the size of these bodies being variable within wide limits. The only thing which is of importance is that the bodies, on the one hand, have a sufficiently great settling rate in the metal bath for which they are intended and that, on the other hand, the bodies do not have too great a thickness in order to possess an acceptable dissolving speed. The maximum thickness of the bodies can be taken as being 50 mm., the preferred range being from 10 to 50 mm.

The production of the formed bodies takes place by an intimate mixing of the powdered components A and B and pressing with conventional technical devices, for example tabletting or briquetting presses. The particle size of component A should be $<1$ mm. and preferably $<500$ μm. and that of component B should be $<1$ mm. and preferably $<150$ μm., in order, after subsequently pressing or compacting, to impart to the formed bodies a correspondingly high inner surface area which, in turn, is of considerable importance for the dissolving speed.

Since most metals when produced by technically conventional processes are not obtained in powdered form, a previous comminution is necessary which, possibly after breaking up, also consist in a milling step in conventional mills, such as ball, vibratory or rebound mills.

The additive according to the present invention, which for alloying is added to the liquid metal bath in an amount of from 0.1 to 25% by weight, sinks, because of its higher specific weight, immediately in the base metal and dissolves completely therein without the formation of a residue, a homogeneous alloy being formed.

As base metal, there can, in principle, be used all metals or alloys with which the elements introduced by means of the additive according to the present invention are compatible and which are specifically lighter than the formed bodies of the additive. Especially preferred base metals include pure aluminium and aluminium alloys, as well as pure magnesium and magnesium alloys, in the case of which the advantages of the present invention, such as high speed of dissolving and high concentration of alloying components are shown especially clearly.

The following Examples are given for the purpose of illustrating the present invention:

influenced by an increase of the chromium content of the mixture from 80.8% to 90.9% and to 96%. Only in the case of the highest chromium content of 96% is there found, in the case of an end content of 0.4% chromium in the aluminium base metal, a slight increase of the necessary dissolving period. On the other hand, in the case of a chromium content of 90.9%, even in the case of end contents of 0.4% chromium, less than 5 minutes dissolving time are necessary in comparison with 10 minutes in the case of the aluminium-containing mixture with only 75.8% chromium.

In the case of comparison Example No. 6. there was used a chloride and fluoride salt-containing mixture. In contradistinction to the mixtures used in Examples Nos. 1 to 5, after the addition to the molten aluminium base metal, a violent reaction resulted in which gases were liberated which burnt on the metal surface with a luminescent flame. Furthermore, about 100 g. of aluminium-containing slag was formed. This corresponded to a loss of aluminium of about 56 g. which did not occur in the case of the salt-free mixtures of Examples Nos. 1 to 5.

TABLE

| Example No. | mixture composition % Cr | % Mg | % Al | % other | % of the theoretical density | dissolving period in minutes* with 0.2% Cr | with 0.4% Cr |
|---|---|---|---|---|---|---|---|
| 1 | 80.8 | 19.2 | — | — | 77 | <5 | <5 |
| 2 | 90.9 | 9.1 | — | — | 73 | <5 | <5 |
| 3 | 96 | 4 | — | — | — | <5 | 10 |
| 4*** | 75.8 | — | 24.2 | — | 77 | <5 | 10 |
| 5*** | 88.4 | — | 11.6 | — | 69 | 15 | 15 |
| 6*** | 75.8 | — | 4.8 | 19.4** | — | 30 | 30 |

*As dissolving period, there was taken the time at which more than 95% of the chromium had gone into solution
**Salt mixture of 62.5% KCl, 20% NaCl and 17.5% $KAlF_4$, all <150 μm. grain size.
***Comparison example

EXAMPLES 1-6

30 kg. of aluminium were kept in a molten state at 730° C. in a 2000 Hz induction furnace. Chromium-containing additives, which consisted of pressed mixtures of 21 mm. diameter and about 25 mm. height, were added to the melt. The chromium addition corresponded to 0.2% of the aluminium. After 5, 10, 15, 30 and 60 minutes, samples were taken and the chromium contents thereof were determined. After complete dissolving, there was again made an addition of chromium corresponding to 0.2% of the aluminium so that the end content of chromium was 0.4%. Samples were taken in the previously described manner.

For the mixture pressed bodies, there was used chromium powder finer than 250 μm., magnesium powder with a grain size of 250-62 μm., as well as aluminium powder with a grain size of 430-75 μm. The intimate mixture was compressed in a tabletting press to about 70 to 80% of the theoretical density.

The following Table gives the mixtures used, the density of the pressed bodies and the dissolving behaviour. Example No. 3 shows that even in the case of 96% chromium in a mixture with magnesium, the dissolving behaviour is comparable with that of comparative Example No. 4 in which only 75.8% of chromium was mixed with aluminium. Furthermore, comparative Example No. 5 shows that the aluminium-containing mixtures react unfavourably to an increase of the proportion of chromium from 75.8 to 88.4% in the mixture, distinctly longer dissolving times being necessary. Examples Nos. 1, 2 and 3 according to the present invention show, on the other hand, that the dissolving behaviour of the magnesium-containing mixtures is much less

I claim:

1. A process for the introduction of alloying metals into melts of aluminum, aluminium alloys, magnesium or magnesium alloys, said process comprising adding to the melt a composition comprising from 2 to 50% by weight of a powdered component A, consisting of magnesium and/or a magnesium-containing alloy, and 50 to 98% by weight of a powdered component B, consisting of one or more alloying metals, the components A and B being intimately mixed and being in pressed or compacted form.

2. The process of claim 1, wherein the magnesium-containing alloy of component A contains at least 50% by weight of magnesium.

3. The process of claim 2, wherein the magnesium-containing alloy additionally contains aluminum or manganese.

4. The process of claim 1, wherein the proportion of component A in the additive is from 5 to 10% by weight, and the proportion of component B is from 90 to 95% by weight.

5. The process of claim 1, wherein the alloying metal of component B is chromium, manganese or iron or a mixture thereof.

6. The process of claim 1, wherein the alloying metal of component B consists of a metla alloy and/or mixture.

7. The process of claim 1, wherein components A and B are in a compacted or compressed body having a thickness of less than 50 mm.

8. The process of claim 7, wherein the powdered components A and B have been mixed and the mixture has been pressed or compacted.

9. The process of claim 7, wherein component A has a particle size of less than 1 mm.

10. The process of claim 9, wherein component A has a particle size of less than 500 μm.

11. The process of claim 9, wherein component B has a particle size of less than 1 mm.

12. The process of claim 11, wherein component B has a particle size of less than 150 μm.

13. The process of claim 7, wherein the compacted or compressed body has a thickness less than 50 mm, component A has a particle size less than 500 μm and component B has a particle size less than 150 μm.

14. The process of claim 13 in which, in the additive, the proportion of component A is from 5 to 10% by weight and the proportion of component B is from 90 to 95% by weight.

15. The process of claim 14, in which the magnesium containing alloy of component A contains at least 50% by weight of magnesium and additionally contains aluminum or manganese.

16. The process of claim 14, wherein the alloying metal of component B is chromium, manganese, iron or a mixture thereof.

17. The process of claim 14, wherein components A and B are in the form of a presssed or compacted body having a thickness of less than 50 mm, component A has a particle size of less than 500 μm, and component B has a particle size of less than 150 μm.

18. In a process for producing metal alloys, wherein a solid alloying element is added to a molten metal bath, the improvement wherein the solid alloying element is in the form of a rapidly dissolving additive comprising 2 to 50% by weight of a powdered component A which consists of magnesium or a magnesium containing alloy, and 50 to 98% of a powdered component B which consists of the alloying element, the component A and B being intimately mixed and in pressed or compacted form, said additive being present in an amount of from 0.1 to 25 wt. % of the molten metal.

* * * * *